US009837716B2

(12) United States Patent
Huang et al.

(10) Patent No.: US 9,837,716 B2
(45) Date of Patent: Dec. 5, 2017

(54) MULTIBAND ANTENNA

(71) Applicant: GETAC TECHNOLOGY CORPORATION, Hsinchu County (TW)

(72) Inventors: Jia-Min Huang, Taipei (TW); Wen-Cheng Chang, Taipei (TW)

(73) Assignee: Getac Technology Corporation, Hsinchu County (TW)

( * ) Notice: Subject to any disclaimer, the term of this patent is extended or adjusted under 35 U.S.C. 154(b) by 17 days.

(21) Appl. No.: 15/076,554

(22) Filed: Mar. 21, 2016

(65) Prior Publication Data

US 2017/0271763 A1 Sep. 21, 2017

(51) Int. Cl.

| | |
|---|---|
| ***H01Q 1/48*** | (2006.01) |
| ***H01Q 5/321*** | (2015.01) |
| ***H01Q 1/24*** | (2006.01) |
| ***H01Q 1/52*** | (2006.01) |

(52) U.S. Cl.

CPC ..... *H01Q 5/321* (2015.01); *H01Q 1/24* (2013.01); *H01Q 1/48* (2013.01); *H01Q 1/52* (2013.01)

(58) Field of Classification Search

USPC ..... 343/846, 702

See application file for complete search history.

(56) References Cited

U.S. PATENT DOCUMENTS

| | | | | |
|---|---|---|---|---|
| 5,926,150 | A * | 7/1999 | McLean | G01R 29/0821 343/700 MS |
| 7,466,276 | B1 * | 12/2008 | Chen | H01Q 1/2258 343/700 MS |
| 7,589,692 | B2 * | 9/2009 | Kim | H01Q 9/0442 343/700 MS |
| 2014/0340265 | A1 * | 11/2014 | Vazquez | H01Q 9/42 343/702 |

* cited by examiner

*Primary Examiner* — Jessica Han
*Assistant Examiner* — Hai Tran

(57) ABSTRACT

A multiband antenna is provided. A resonance path is provided by a first connection segment and a low-frequency radiating element with a closed pattern to enable the multiband antenna to support a low frequency band, wherein a first side of the closed pattern is wider than a second side of the closed pattern. The second side of the closed pattern is connected to one end of the first connection segment. The other end of the first connection segment is connected to a feed element.

16 Claims, 3 Drawing Sheets

MULTIBAND ANTENNA

BACKGROUND OF THE INVENTION

Field of the Invention

The present invention relates to antennas and, more particularly, to an antenna that supports multiple frequency bands.

Description of the Prior Art

Antennas have to change with communication-related technological advancements in order to meet frequency band requirements for the latest generation of communication technology. LTE (Long-Term Evolution), a major standard for 4G (fourth generation) wireless communication technology, surpasses 3G mobile communication technology in bandwidth and data transmission speed. However, antenna design is confronted with a challenge, that is, complying simultaneously with the requirements of conventional communication electronic devices for being lightweight, thin and compact, the requirements of 4G wireless communication technology in terms of frequency bands, and the limitation of communication electronic device on antenna size.

SUMMARY OF THE INVENTION

The present invention provides a multiband antenna that supports frequency bands required by 4G wireless communication technology and is advantageously compact to therefore suit lightweight, thin and compact communication electronic devices.

The multiband antenna of the present invention comprises a short-circuit element, feed element, first connection segment and low-frequency radiating element. The first end of the short-circuit element has a grounding point. The short-circuit element is connected to the ground through the grounding point. The first end of the feed element has a feed point. The feed element has a second end connected to the short-circuit element. The feed element receives a feed signal through the feed point. The first connection segment has a first end connected to a second end of the short-circuit element. The low-frequency radiating element has a closed pattern. The closed pattern has a first side and a second side opposing the first side. The first side is of a larger width than the second side. The second side is connected to the second end of the first connection segment.

In an embodiment of the present invention, the closed pattern comprises a second connection segment, a third connection segment and a fourth connection segment. The fourth connection segment, second connection segment and third connection segment together form the triangular closed pattern. A common connection end of the second connection segment and fourth connection segment functions as the second side of the closed pattern. The third connection segment functions as the first side of the closed pattern. The first, the second, the third and the fourth connection segments provide a resonance path whereby the multiband antenna supports low frequency bands.

In an embodiment of the present invention, the low frequency band ranges from 690 MHz to 960 MHz.

In an embodiment of the present invention, the first, second, the third and the fourth connection segments provide the resonance path whereby the multiband antenna supports a multiplied frequency band.

In an embodiment of the present invention, the multiplied frequency band ranges from 2400 MHz to 2600 MHz.

In an embodiment of the present invention, the multiband antenna further comprises a first grounding surface coupled to the first end of the short-circuit element, parallel to the low-frequency radiating element, and separated from the low-frequency radiating element by a first distance.

In an embodiment of the present invention, an area of projection of the closed pattern upon a plane of the first grounding surface falls within the first grounding surface.

In an embodiment of the present invention, the multiband antenna further comprises a first high-frequency radiating element connected to the first connection segment to provide a first resonance path whereby the multiband antenna supports a first high frequency band.

In an embodiment of the present invention, the multiband antenna further comprises a second connection segment and a second grounding surface. The second connection segment has a first end connected to the first grounding surface. The second grounding surface is connected to a second end of the second connection segment, parallel to the first high-frequency radiating element, and separated from the first high-frequency radiating element by a second distance. The first distance is larger than the second distance.

In an embodiment of the present invention, the multiband antenna further comprises a second high-frequency radiating element connected to the first connection segment to provide a second resonance path whereby the multiband antenna supports a second high frequency band, with the second high-frequency radiating element separated from the second grounding surface by the second distance.

In an embodiment of the present invention, the first high frequency band and the second high frequency band support a frequency band of 1710 MHz through 2200 MHz.

In an embodiment of the present invention, the first resonance path is of a larger length than the second resonance path.

In conclusion, in the embodiments of the present invention, resonance paths provided by a first connection segment and a low-frequency radiating element with a closed pattern enable the multiband antenna to support a low frequency band and a multiplied frequency band, whereas a resonance path provided by high-frequency radiating elements enables the multiband antenna to support high frequency bands, so as for the multiband antenna to meet the requirements of 4G wireless communication technology in terms of various frequency bands and effectively reduce the required size of the antenna, thereby allowing the multiband antenna to be easily disposed in various communication electronic device. The closed pattern has a first side and a second side. The first side is of a larger width than the second side. The second side is connected to a second end of the first connection segment.

To render the above technical features and advantages of the present invention obvious and comprehensible, the prevent invention is illustrated with embodiments, depicted with drawings, and described below.

DETAILED DESCRIPTION OF THE EMBODIMENTS

Figure 1:
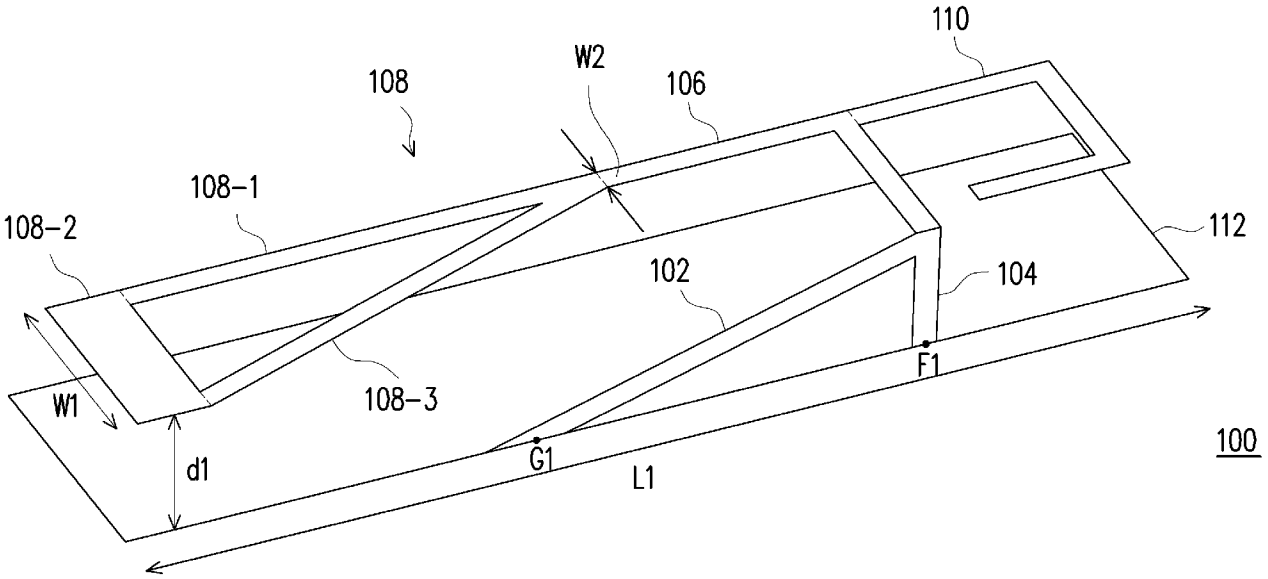
FIG. 1 is a schematic view of a multiband antenna according to an embodiment of the present invention.

FIG. 1 is a schematic view of a multiband antenna according to an embodiment of the present invention. As shown in FIG. 1, a multiband antenna 100 comprises a short-circuit element 102, a feed element 104, a first connection segment 106, a low-frequency radiating element 108, a high-frequency radiating element 110 and a first grounding surface 112. The first end of the short-circuit element 102 has a grounding point G1. The short-circuit element 102 is connected to the first grounding surface 112 through the grounding point G1. The first grounding surface 112 is parallel to the first connection segment 106 and the low-frequency radiating element 108 and is separated from the low-frequency radiating element 108 by a first distance d1. The first end of the feed element 104 has a feed point F1. The first end of the feed element 104 is connected to the first grounding surface 112 through a feed signal source (not shown). The feed element 104 receives a feed signal through the feed point F1. The second end of the short-circuit element 102 and the second end of the feed element 104 are connected to the first end of the first connection segment 106. The second end of the first connection segment 106 is connected to the low-frequency radiating element 108. In this embodiment, the first connection segment 106 is an L-shaped connection segment. The low-frequency radiating element 108 has a closed pattern. The area of projection of the closed pattern upon the plane of the first grounding surface 112 falls within the first grounding surface 112. The closed pattern has a first side and a second side opposing the first side. The width W1 of the first side is larger than the width W2 of the second side. The second side is connected to the second end of the first connection segment 106.

Referring to FIG. 1, in this embodiment, the closed pattern is a triangle. The first side of the closed pattern is one of the three sides of the triangle, and the second side of the closed pattern is a vertex of the triangle. Furthermore, the low-frequency radiating element 108 comprises a second connection segment 108-1, a third connection segment 108-2 and a fourth connection segment 108-3. The second connection segment 108-1, the third connection segment 108-2 and the fourth connection segment 108-3 together form the triangular closed pattern. A common connection end of the second connection segment 108-1 and the fourth connection segment 108-3 functions as the second side of the closed pattern. The third connection segment 108-2 functions as the first side of the closed pattern. The first connection segment 106, the second connection segment 108-1, the third connection segment 108-2 and the fourth connection segment 108-3 provide resonance path whereby the multiband antenna 100 supports a low-frequency band, and the low frequency band ranges from 690 MHz to 960 MHz to meet the requirements of 4G wireless communication technology in terms of low-frequency bands.

Furthermore, the high-frequency radiating element 110 is connected to the first connection segment 106. Referring to FIG. 1, one end of the high-frequency radiating element 110 is connected to a bend of the first connection segment 106, but the present invention is not limited thereto. The other end of the high-frequency radiating element 110 is an open circuit end. The first connection segment 106 and the high-frequency radiating element 110 provide the resonance path (which begins at the first end of the first connection segment 106 and ends at the open circuit end of the high-frequency radiating element 110) whereby the multiband antenna 100 supports a high-frequency band, and the high-frequency band ranges from 1710 MHz to 2200 MHz. Moreover, the resonance path provided by the second connection segment 108-1, the third connection segment 108-2 and the fourth connection segment 108-3 of the low-frequency radiating element 108 and the first connection segment 106 enables the multiband antenna 100 to support a multiplied frequency band by frequency multiplication such that multiplied frequencies, such as 1600 MHz, 2400 MHz, which are two times, three time or multiple times higher than the central operating frequency, such as 800 Hz, of the low-frequency radiating element 108, are generated. In this embodiment, the multiplied frequency band ranges from 2400 MHz to 2600 MHz. Therefore, the high-frequency radiating element 110 provides the resonance path whereby the multiband antenna 100 supports high-frequency bands, whereas the first connection segment 106 and the low-frequency radiating element 108 provide the resonance path whereby the multiband antenna 100 supports a multiplied frequency band, to meet the requirements of 4G wireless communication technology in terms of high-frequency bands.

Figure 2:
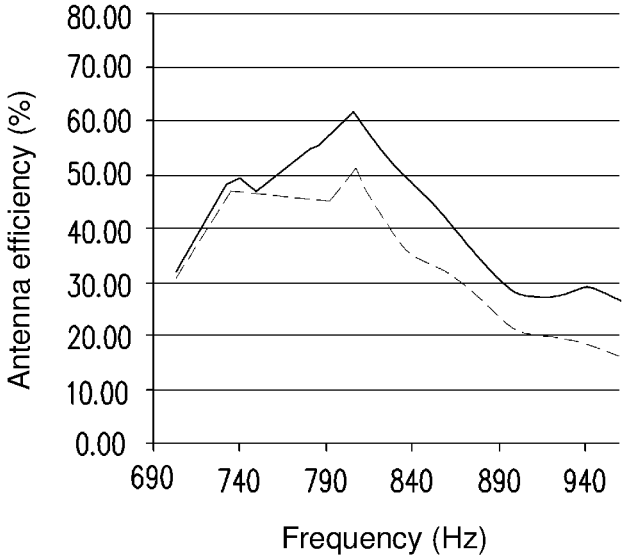
FIG. 2 is a graph of antenna efficiency of the multiband antenna operating at a low frequency band according to the embodiment shown in FIG. 1.
Figure 3:
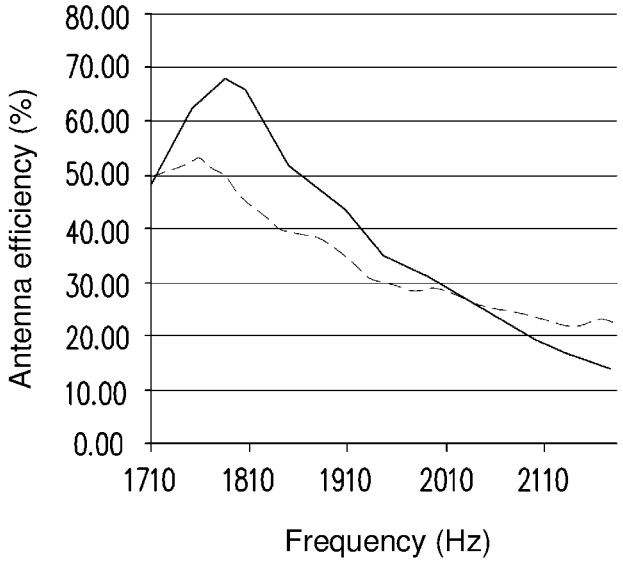
FIG. 3 is a graph of antenna efficiency of the multiband antenna operating at a high frequency band according to the embodiment shown in FIG. 1.

FIG. 2 is a graph of antenna efficiency of the multiband antenna operating at a low frequency band according to the embodiment shown in FIG. 1. FIG. 3 is a graph of antenna efficiency of the multiband antenna operating at a high-frequency band according to the embodiment shown in FIG. 1. Referring to FIG. 2, the multiband antenna 100 of the embodiment shown in FIG. 1 markedly surpasses a conventional 4G antenna in antenna efficiency, when operating at a low frequency band, where the solid curve indicates the multiband antenna 100, and the dashed curve indicates the conventional 4G antenna. Referring to FIG. 2, for example, the multiband antenna 100 achieves an antenna efficiency of 62% approximately, whereas the conventional 4G antenna achieves an antenna efficiency of 52% approximately, at 800 Hz. Referring to FIG. 3, the multiband antenna 100 of the embodiment shown in FIG. 1 markedly surpasses the conventional 4G antenna in antenna efficiency, when operating at high-frequency bands, where the solid curve indicates the multiband antenna 100, and the dashed curve indicates the conventional 4G antenna. Referring to FIG. 3, for example, the multiband antenna 100 achieves an antenna efficiency of 68% approximately, whereas the conventional 4G antenna achieves an antenna efficiency of 50% approximately, at 1800 Hz.

In this embodiment, the multiband antenna 100 is characterized in that: the resonance path provided by the first connection segment 106 and the low-frequency radiating element 108 with a closed pattern enables the multiband antenna 100 to support a low frequency band and multiplied frequency band; and the resonance path provided by the high-frequency radiating element 110 enables the multiband antenna 100 to support high frequency bands, thereby allowing the multiband antenna 100 to meet the requirements of 4G wireless communication technology in terms of various frequency bands. Moreover, in this embodiment, the structure of the multiband antenna 100 effectively reduces the required size of the antenna. In the embodiment shown in FIG. 1, the multiband antenna 100 is of a length L1 as small as 7 cm such that the multiband antenna 100 can be easily disposed in various communication electronic devices.

Figure 4:
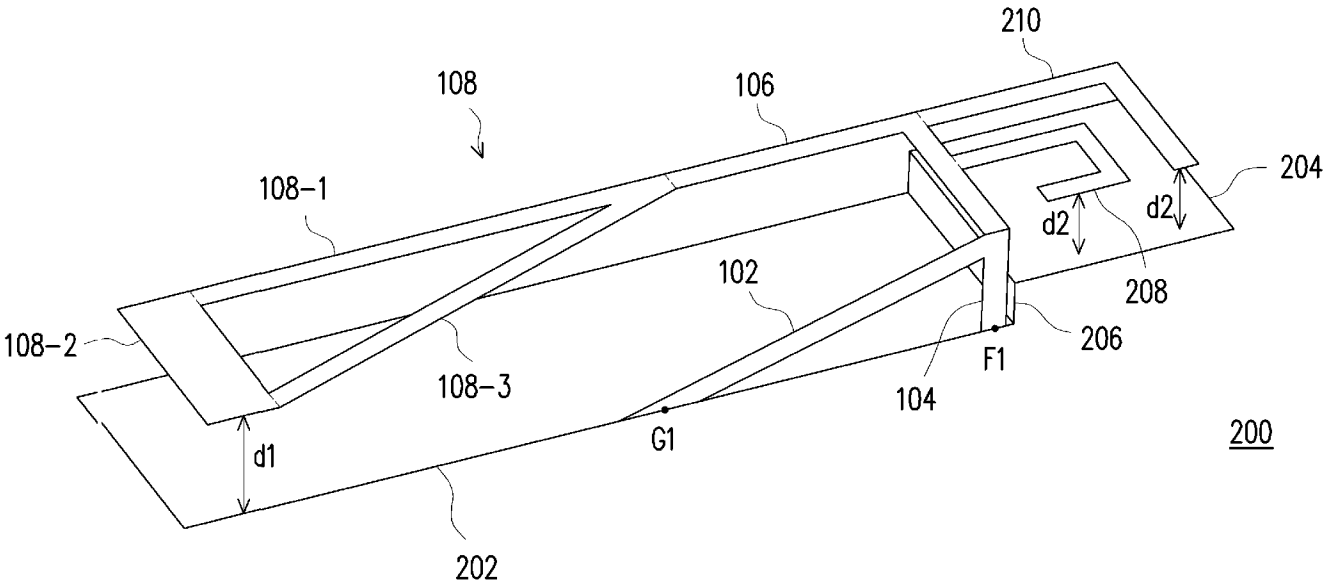
FIG. 4 is a schematic view of the multiband antenna according to another embodiment of the present invention.

FIG. 4 is a schematic view of the multiband antenna according to another embodiment of the present invention. As shown in FIG. 4, a multiband antenna 200 of this embodiment differs from the multiband antenna 100 of the embodiment shown in FIG. 1 in that the multiband antenna 200 of this embodiment comprises a first grounding surface 202, second grounding surface 204 and connection segment 206 for connecting the first grounding surface 202 and second grounding surface 204. The first grounding surface 202, second grounding surface 204 and connection segment 206 differ in height. The multiband antenna 200 further comprises two high-frequency radiating elements 208, 210. The first grounding surface 202 is similar to the first grounding surface 112 of the embodiment shown in FIG. 1. The first grounding surface 202 is connected to the short-circuit element 102 and the feed element 104 and separated from the low-frequency radiating element 108 by a first distance d1. The second grounding surface 204 is parallel to the high-frequency radiating elements 208, 210 and separated from the high-frequency radiating elements 208, 210 by a second distance d2. The first distance d1 is larger than the second distance d2. Furthermore, the first end and second end of the connection segment 206 are connected to the first grounding surface 202 and second grounding surface 204, respectively. Therefore, the high-frequency radiating elements are closer to the grounding surface to enhance the energy of the coupling of the high-frequency radiating elements 208, 210 to the second grounding surface 204 and thereby enhance the quality of signal reception of the multiband antenna 200. Moreover, in this embodiment, the high-frequency radiating elements 208, 210 provide resonance paths. The resonance path provided by the high-frequency radiating element 208 is longer than the resonance path provided by the high-frequency radiating element 210. The resonance paths provided by the high-frequency radiating elements 208, 210 enable the multiband antenna 200 to support two high frequency bands. The two high frequency bands range from 1710 MHz to 2200 MHz, thereby allowing the multiband antenna 200 to meet the requirements of 4G wireless communication technology in terms of high frequency bands.

In conclusion, in the embodiments of the present invention, resonance paths provided by a first connection segment and a low-frequency radiating element with a closed pattern enable the multiband antenna to support a low frequency band and a multiplied frequency band, whereas a resonance path provided by high-frequency radiating elements enables the multiband antenna to support high frequency bands, so as for the multiband antenna to meet the requirements of 4G wireless communication technology in terms of various frequency bands and effectively reduce the required size of the antenna, thereby allowing the multiband antenna to be easily disposed in various communication electronic device. The closed pattern has a first side and a second side. The first side is of a larger width than the second side. The second side is connected to a second end of the first connection segment.

Although the present invention is disclosed above by embodiments, the embodiments are not restrictive of the present invention. Any persons skilled in the art can make some changes and modifications to the embodiments without departing from the spirit and scope of the present invention. Accordingly, the legal protection for the present invention should be defined by the appended claims.

What is claimed is:

1. A multiband antenna, comprising:

a short-circuit element comprising a first end having a grounding point, the short-circuit element connecting to a ground through the grounding point;

a feed element comprising a first end having a feed point, wherein a second end of the feed element is connected to the short-circuit element, and the feed element receives a feed signal through the feed point;

a first connection segment comprising a first end connected to a second end of the short-circuit element;

a low-frequency radiating element with a closed pattern having a first side and a second side opposing the first side, with the first side being of a larger width than the second side, wherein the second side is connected to a second end of the first connection segment, wherein the closed pattern comprises a second connection segment, a third connection segment, and a fourth connection segment arranged in a triangular closed loop defining an opening there between;

a high-frequency radiating element connected to the first connection segment to provide a first resonance path whereby the multiband antenna supports a first high frequency band; and a grounding surface coupled to the first end of the short-circuit element, parallel to the low-frequency radiating element and the high-frequency radiating element, and separated from the low-frequency radiating element by a first distance.

2. The multiband antenna of claim 1, wherein a common connection end of the second connection segment and the fourth connection segment functions as the second side of the closed pattern, and the third connection segment functions as the first side of the closed pattern, wherein the first, second, third and fourth connection segments provide a resonance path whereby the multiband antenna supports a low frequency band.

3. The multiband antenna of claim 2, wherein the low frequency band ranges from 690 MHz to 960 MHz.

4. The multiband antenna of claim 2, wherein the first, second, third and fourth connection segments provide the resonance path whereby the multiband antenna supports a multiplied frequency band.

5. The multiband antenna of claim 4, wherein the multiplied frequency band ranges from 2400 MHz to 2600 MHz.

6. The multiband antenna of claim 1, wherein an area of projection of the closed pattern upon a plane of the grounding surface falls within the first grounding surface.

7. A multiband antenna, comprising:

a short-circuit element comprising a first end having a grounding point, the short-circuit element connecting to a ground through the grounding point;

a feed element comprising a first end having a feed point, wherein a second end of the feed element is connected to the short-circuit element, and the feed element receives a feed signal through the feed point;

a first connection segment comprising a first end connected to a second end of the short-circuit element;

a low-frequency radiating element with a closed pattern having a first side and a second side opposing the first side, with the first side being of a larger width than the second side, wherein the second side is connected to a second end of the first connection segment;

a first grounding surface coupled to the first end of the short-circuit element, parallel to the low-frequency radiating element, and separated from the low-frequency radiating element by a first distance;

a first high-frequency radiating element connected to the first connection segment to provide a first resonance path whereby the multiband antenna supports a first high frequency band;

a second connection segment comprising a first end connected to the first grounding surface; and a second grounding surface connected to a second end of the second connection segment, parallel to the first high-frequency radiating element, and separated from the first high-frequency radiating element by a second distance, wherein the first distance is larger than the second distance.

8. The multiband antenna of claim 7, further comprising:

a second high-frequency radiating element connected to the first connection segment to provide a second resonance path whereby the multiband antenna supports a second high frequency band, wherein the second high-frequency radiating element is separated from the second grounding surface by the second distance.

9. The multiband antenna of claim 8, wherein the first high frequency band and the second high frequency band support a frequency band of 1710 MHz through 2200 MHz.

10. The multiband antenna of claim 9, wherein the first resonance path is of a larger length than the second resonance path.

11. The multiband antenna of claim 7, wherein the closed pattern comprises a second connection segment, a third connection segment, and a fourth connection segment arranged in a triangular closed loop defining an opening there between.

12. The multiband antenna of claim 11, wherein a common connection end of the second connection segment and the fourth connection segment functions as the second side of the closed pattern, and the third connection segment functions as the first side of the closed pattern, wherein the first, second, third and fourth connection segments provide a resonance path whereby the multiband antenna supports a low frequency band.

13. The multiband antenna of claim 11, wherein the low frequency band ranges from 690 MHz to 960 MHz.

14. The multiband antenna of claim 11, wherein the first, second, third and fourth connection segments provide the resonance path whereby the multiband antenna supports a multiplied frequency band.

15. The multiband antenna of claim 14, wherein the multiplied frequency band ranges from 2400 MHz to 2600 MHz.

16. The multiband antenna of claim 7, wherein an area of projection of the closed pattern upon a plane of the first grounding surface falls within the first grounding surface.

* * * * *